United States Patent [19]

Wilson et al.

[11] Patent Number: 4,539,955

[45] Date of Patent: Sep. 10, 1985

[54] IDLE SPEED CONTROL DEVICE FOR INTERNAL COMBUSTION ENGINE

[75] Inventors: Robert E. Wilson, Beaver Creek; Gustavus P. Bock, Bellbrook, both of Ohio

[73] Assignee: General Motors Corporation, Detroit, Mich.

[21] Appl. No.: 648,037

[22] Filed: Sep. 6, 1984

[51] Int. Cl.[3] ..... F02D 11/10

[52] U.S. Cl. ..... 123/339; 123/350

[58] Field of Search ..... 123/339, 352, 361, 354, 123/355, 376, 350, DIG. 11

[56] References Cited

U.S. PATENT DOCUMENTS

| | | | |
|---|---|---|---|
| 4,212,272 | 11/1978 | Hawk | 123/339 |
| 4,363,303 | 8/1981 | Takayama | 123/339 |
| 4,395,985 | 9/1981 | Hagen | 123/339 |
| 4,412,517 | 4/1981 | Kobashi et al. | 123/339 |
| 4,436,069 | 3/1984 | Collonia | 123/339 |

*Primary Examiner*—Raymond A. Nelli
*Attorney, Agent, or Firm*—R. L. Phillips

[57] ABSTRACT

An idle speed control device is disclosed for an internal combustion engine controlled by a throttle wherein the device has a throttle stop positioning shaft for the throttle and a threaded drive gear that engages threads on the shaft and on turning in one direction retracts the shaft and connected throttle stop on turning in the opposite direction extends the shaft to a maximum throttle stop positioned where the gear disengages from the shaft and then can freewheel in the opposite direction without forcing further extension of the shaft. A conical spring received on the shaft has a small diameter end adapted to self-lock to the shaft and a large diameter end adapted to be engaged by the gear to compress the spring as the shaft is fully extended whereby the spring is loaded to forcibly re-engage the gear with the shaft when the gear is turned in the one direction to initiate retraction of the throttle stop when fully extended.

3 Claims, 3 Drawing Figures

IDLE SPEED CONTROL DEVICE FOR INTERNAL COMBUSTION ENGINE

TECHNICAL FIELD

This invention relates to an idle speed control device for an internal combustion engine and more particularly to biasing means for assuring re-engagement of a threaded coupling therein with the throttle stop.

BACKGROUND OF THE INVENTION

In U.S. Pat. No. 4,212,272 there is disclosed an idle speed control device for an internal combustion engine wherein the normally available biasing force of the throttle return spring is used at maximum throttle stop extension to initiate threaded re-engagement between a then free-wheelable drive gear and the throttle stop to retract the latter on reversal of the device's actuator motor that powers this gear to position the stop. However, this re-engagement force may not always be available in certain carburetor or fuel injection system control applications or when the throttle stop actuator motor is operated to retract but the throttle return force is held off the throttle stop by the vehicle operator by leaving the throttle pedal depressed.

SUMMARY OF THE INVENTION

The present invention provides improvement in an idle speed control device of the above type in effecting the threaded re-engagement between the throttle stop and the noted drive gear. According to the present invention, a biasing means is operatively arranged between the noted drive gear and the throttle stop so as to be loaded by the full extension of the latter and then be effective to forcibly assure the threaded re-engagement with the drive gear independent of any external force such as by a throttle return spring. Preferably, the biasing means is in the form of a conical wire spring received about and mounted on the throttle stop. The conical spring has a small diameter end that self-locks to the throttle stop and a large diameter end that is positioned thereby and adapted to be engaged by the drive gear so as to compress the spring as the throttle stop is fully extended. As a result, the spring is loaded with minimized unit area loading on the drive gear to forcibly effect the re-engagement of the drive gear when the latter is reversed from its free-wheeling turning direction to initiate retraction of the throttle stop from full extension.

These and other objects, features and advantages of the present invention will become more apparent from the following description and drawing in which:

DESCRIPTION OF THE PREFERRED EMBODIMENT

Figure 1:
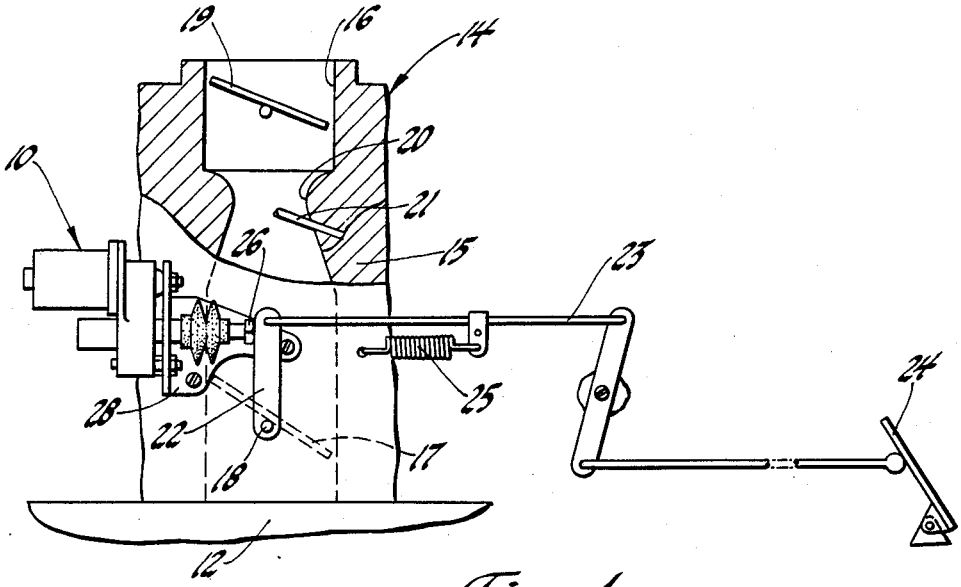
FIG. 1 is an elevational view of the preferred form of the idle speed control device according to the present invention mounted on the carburetor of a motor vehicle internal combustion engine, the carburetor being shown diagrammatically and partly broken away.

Referring to FIG. 1, the idle speed control device identified by the reference number 10 is operable to control the idle speed of an internal combustion engine 12 of a motor vehicle, not shown. The engine 12, of which only a top portion is shown, has a carburetor 14 having a throttle body 15 with a throttle bore 16 in which a throttle valve 17 is pivotably mounted by a shaft 18 below a choke valve 19. The throttle valve 17 is located downstream of a venturi 20 into which fuel is delivered by a nozzle 21 in conventional manner. The throttle valve shaft 18 has a lever 22 fixed thereto which is operably connected by linkage 23 to an accelerator pedal 24 located in the floor space of the vehicle's passenger compartment on the driver's side. The throttle valve is normally opened by the vehicle operator depressing the accelerator pedal and when the operator releases foot control thereof, the throttle lever is returned and held by a return spring 25 against a throttle stop 26 on the idle speed control device 10, the latter being mounted by a bracket 28 on the throttle body 15.

The idle speed control device 10 is operable to adjust the position of the throttle stop 26 thereby controlling the minimum open position of the throttle valve and thus the engine's idle speed when the operator releases the accelerator pedal.

Figure 2:
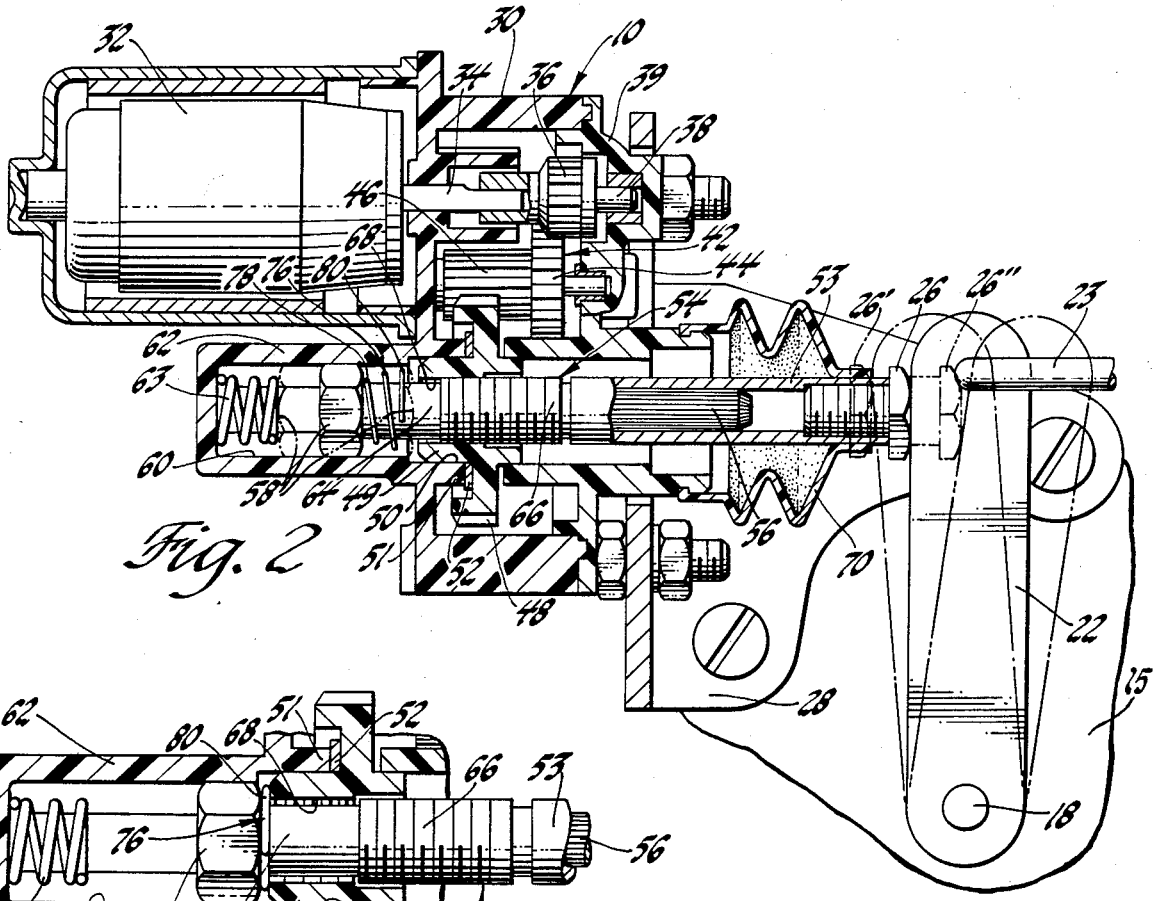
FIG. 2 is an enlarged longitudinal sectional view with parts broken away of the idle speed control device in FIG. 1 with the throttle stop shown in solid line in an intermediate position.

The idle speed control device apart from the thread re-engagement biasing feature of the present invention is like that disclosed in the afore-mentioned U.S. Pat. No. 4,212,272 which is hereby incorporated by reference. As seen in FIG. 2, the idle speed control device 10 comprises a housing 30 on which an enclosed DC motor 32 is mounted having a shaft 34 extending into the housing. Drive from the motor to the throttle stop is provided by a pinion 36 which is keyed at one end to the motor shaft and has a spindle 38 at the other end supported in a cover 39 bolted to the open end of the housing 30. The pinion 36 drives an idler 42 which is rotatably supported at opposite ends in the housing 30 and cover 39. The idler 42 has a large diameter gear 44 which meshes with the pinion 36 and a small diameter elongated gear 46 which meshes with an annular throttle stop drive gear 48. The throttle stop drive gear 48 has a hub 49 by which it is rotatably supported by a bore 50 in the housing in an inwardly projecting portion 51. The drive gear 48 is also permitted to move axially and against a thrust washer 52 on the left gear side but only to a limited extent and while retaining meshing engagement with the small idler gear 46 which is elongated for that purpose. The limited movement of the throttle stop drive gear is for the operation of a switch (not shown) to enable motor operation and thus idle speed control as described in detail in the aforementioned U.S. Pat. No. 4,212,272 and to which reference may be made for further understanding thereof.

The throttle stop 26 is part of an assembly which is translated by the drive gear 48 between a maximum retraction position as shown by the extreme leftmost phantom-line position 26' establishing minimum idle throttle valve opening and a maximum extension position as shown by the rightmost phantom line position 26'' establishing maximum idle throttle valve opening with the accelerator pedal released. The throttle stop assembly further includes a sleeve 53 to which the throttle stop 26 is threaded in the right-hand end thereof and a solid shaft 54 having a serrated portion 56 by which such shaft is press-fittedly retained in the left-hand end of the sleeve 53. The shaft 54 has a hexagonal shaped head 58 which is slidably received in a correspondingly shaped but elongated socket 60 that is axially aligned with the drive gear 48 and formed in a boss 62 integral with and projecting outwardly from the device's housing 30. The shaft 54 and connected throttle stop 26 is thereby permitted to transmit axially of the throttle stop drive gear 48 but is prevented from rotation by the socket 60 which in addition to receiving the head 58 for that purpose also contains a stop spring 63 therefor as explained in more detail later. The shaft 54 adjacent its hexagonal head 58 has a plain cylindrical portion 64 that is equal or slightly greater in length than the length of the throttle stop drive gear's hub 49 for reasons that will become more apparent later. The shaft 54 has immediately adjacent its cylindrical portion 64 opposite the head 58 an enlarged diameter portion having a right-hand screw thread 66 which engages with an internal nut thread 68 formed in the hub 49 of the throttle stop drive gear 48. The throttle stop 26 has a hexagonal head for engagement by a wrench to provide adjustment and the throttle stop projects outwardly from the device to be engaged by the throttle lever with there being provided a bellows-type boot 70 between the throttle stop and the cover 39 to prevent entry of foreign matter.

The idle speed control device 10 is adapted to operate in a motor vehicle with an electronic control unit that applies a DC voltage of reversible polarity to the motor to cause the motor drive to turn in either direction and for a certain period of time to establish or maintain a desired engine idle speed under various conditions.

Figure 3:
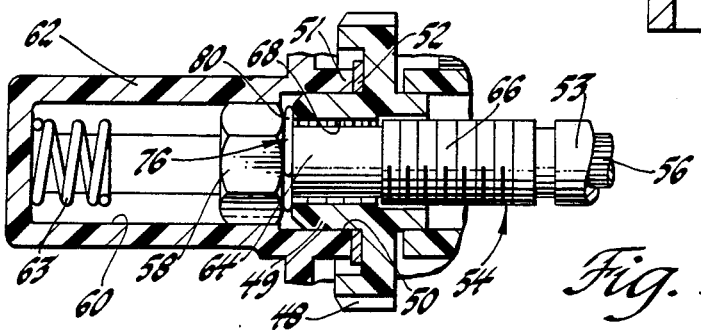
FIG. 3 is an enlarged view of a portion of the device in FIG. 2 but with the throttle stop shown in its maximum extended position.

Describing now the typical operation of the device in such an application, when the vehicle operator releases the accelerator pedal 24, the throttle return spring 25 normally forces and holds the throttle lever 22 against the throttle stop 26. The initial contact of the throttle lever with the throttle stop forces conjoint limited movement of the throttle stop assembly until the throttle stop drive gear 48 which is moved therewith is stopped by the thrust washer 52 after having moved from its other extreme position. This limited movement of the throttle stop drive gear 65 operates the aforementioned switch in the device to enable operation of the motor 32. So long as the accelerator pedal remains released, voltage may then be applied to the motor according to a prescribed program and when the polarity is such that the motor causes the throttle stop drive gear to turn in the counterclockwise direction as viewed from the right-hand end of the throttle stop, and with the drive gear 48 and shaft 54 in threaded engagement as shown in FIG. 2 and the shaft prevented from rotation by the head 58 in the socket 60, the shaft and connected throttle stop 26 are caused to move leftwardly or retract and stop on cessation of motor operation. This permits the spring biased throttle lever 22 to pivot counterclockwise to a new position thereby decreasing the idle setting. Continued motor operation in this mode eventually causes the hexagonal head 58 of the shaft to contact and slightly compress the stop spring 63. This spring engagement determines the maximum retraction of the throttle stop and thus minimum throttle valve opening and is depicted by the throttle stop position 26'. On the other hand, when a higher idle speed is demanded, voltage of opposite polarity is then applied to the motor causing the drive gear 48 to turn in the opposite direction to extend the throttle stop by operation of the threaded coupling 66, 68 therewith. The spring 63 then expands to assist the shaft 54 in moving out of its extreme left-hand position while with the drive gear rotating the throttle return spring normally maintains the drive gear leftward against the thrust washer as the drive gear turns to maintain voltage to the motor as earlier described. The shaft 54 and connected throttle stop 26 is thus caused to move rightward pivoting the throttle lever 22 clockwise to a higher idle setting and with cessation of the motor operation according to program stopping the throttle stop at the demanded position. Continued extension of the throttle stop can occur to the position 26" at which point the shaft thread 66 disengages from the drive gear thread 68 as shown in FIG. 3 whereupon the motor can continue to turn in its advancing direction without stalling because the drive gear then freewheels about the unthreaded portion 64 of the shaft. Then when the motor is reversed to turn the drive gear in the opposite direction, the force normally applied to the shaft 54 by the throttle return spring with the throttle pedal released would force threaded re-engagement of the shaft with the drive gear whereupon such engagement is effective to then cause retraction of the throttle stop as before described.

According to the present invention and instead of relying on the throttle return spring force, there is added biasing means preferably in the form of a conical wire spring 76 which is received on the unthreaded portion 64 of the shaft 54 between the hexagonal head 58 and the threaded portion 66. The small diameter end 78 of the spring is adapted to self-lock to the shaft and thereby center the large diameter 80 of the spring in position to engage the hub 49 of the drive gear 48 radially outward of the threaded portion 66 and be fully compressed as the throttle stop is advanced to its maximum idle position 26". The spring 76 is designed so that when it is compressed, each coil nests inside without interference from the preceding coil and the spring can thereby assume a flat one-coil profile as shown in FIG. 3 with the throttle stop fully extended. Thus, when the throttle stop is in its fully extended position and the motor is operated to retract same, the conical spring 76 is then loaded a prescribed amount to forcibly but smoothly without impact re-engage the drive gear thread 68 with the shaft thread 66 to thereby assure proper thread engagement and retraction of the shaft with the throttle stop from full extension. Moreover, with such internal loading on the drive gear in the maximum extension position, the idle stop actuator is then suitable for use in an application where it is desired to retract the throttle stop without the throttle lever being in forced contact therewith. Furthermore, it will be seen that with the larger diameter end of the conical spring engaging the drive gear, the load is distributed radially outward thereby minimizing the unit area loading thereon to extend its durability.

It will also be understood by those skilled in the art that while the idle speed control device or actuator according to the present invention has been described in use to control a throttle valve lever, the device is also adaptable for use in other engine fuel control systems wherein a throttle valve or the like is adjustable to control engine idle speed. And it will be further understood that the above described preferred embodiment is intended to be illustrative of the invention which may be modified within the scope of the appended claims.

The embodiments of the invention in which an exclusive property or privilege is claimed are defined as follows:

1. An idle speed control device for an internal combustion engine controlled by a throttle wherein the device has a throttle stop positioning shaft for the throttle and a threaded drive gear that engages threads on the shaft and on turning in one direction retracts the shaft and on turning in the opposite direction extends the shaft to a full extension position where the gear disengages from the shaft and then can freewheel in said opposite direction without forcing further extension of the shaft, characterized by spring means for forcibly re-engaging the gear with the shaft when the gear is turned in said one direction to initiate retraction of the shaft when fully extended.

2. An idle speed control device for an internal combustion engine controlled by a throttle wherein the device has a throttle stop positioning shaft for the throttle and a threaded drive gear that engages threads on the shaft and on turning in one direction retracts the shaft and on turning in the opposite direction extends the shaft to a full extension position where the gear disengages from the shaft and then can freewheel in said opposite direction without forcing further extension of the shaft, characterized by spring means for engaging and being loaded against the gear as the shaft is fully extended so as to thereafter forcibly re-engage the gear with the shaft when the gear is turned in said one direction to initiate retraction of the shaft when fully extended.

3. An idle speed control device for an internal combustion engine controlled by a throttle wherein the device has a throttle stop positioning shaft for the throttle and a threaded drive gear that engages threads on the shaft and on turning in one direction retracts the shaft and on turning in the opposite direction extends the shaft to a full extension position where the gear disengages from the shaft and then can freewheel in said opposite direction without forcing further extension of the shaft, characterized by a conical spring received on the shaft having a small diameter end adapted to self-lock to the shaft and a large diameter end adapted to be engaged by the gear to compress the spring as the shaft is fully extended whereby the spring is loaded to forcibly re-engage the gear with the shaft when the gear is turned in said one direction to initiate retraction of the shaft when fully extended.

* * * * *